US007263796B2

(12) United States Patent
Kellermann et al.

(10) Patent No.: US 7,263,796 B2
(45) Date of Patent: Sep. 4, 2007

(54) TRIGGER SYSTEM FOR HAND FIREARMS

(75) Inventors: Harald Kellermann, Eckernförde (DE); Jens-Peter Bremer, Eckenförde (DE)

(73) Assignee: S.A.T. Swiss Arms Technology AG, Neuhausen (CH)

( * ) Notice: Subject to any disclaimer, the term of this patent is extended or adjusted under 35 U.S.C. 154(b) by 0 days.

(21) Appl. No.: 11/210,470

(22) Filed: Aug. 24, 2005

(65) Prior Publication Data

US 2006/0064912 A1 Mar. 30, 2006

(30) Foreign Application Priority Data

Sep. 30, 2004 (EP) ..... 04023314

(51) Int. Cl.
*F41A 19/14* (2006.01)
*F41A 19/51* (2006.01)

(52) U.S. Cl. ..... 42/69.03; 89/147

(58) Field of Classification Search ..... 42/65, 42/69.03; 89/147

See application file for complete search history.

(56) References Cited

U.S. PATENT DOCUMENTS 2,846,925 A 8/1958 Norman
3,152,418 A 10/1964 Charron
3,656,249 A * 4/1972 Raville ..... 42/69.03
4,021,955 A * 5/1977 Curtis ..... 42/70.08
4,208,947 A * 6/1980 Hillberg ..... 89/148
4,275,640 A * 6/1981 Wilhelm ..... 89/147
4,282,795 A * 8/1981 Beretta ..... 89/148
4,536,981 A * 8/1985 Giragosian ..... 42/69.03
4,589,327 A * 5/1986 Smith ..... 89/148
5,088,222 A * 2/1992 Larson ..... 42/70.04
5,208,406 A * 5/1993 Badali ..... 42/70.08
5,797,206 A * 8/1998 Vitorino ..... 42/69.03

FOREIGN PATENT DOCUMENTS

WO WO 2004/074759 A1 9/2004

* cited by examiner

*Primary Examiner*—Bret Hayes
(74) *Attorney, Agent, or Firm*—Martin Fleit; Paul D. Bianco; Fleit Kain Gibbons Gutman Bongini & Bianco P.L.

(57) ABSTRACT

The invention relates to a trigger system for hand firearms with a hammer, a catch allocated to the hammer, a trigger, and a trigger arm interacting with this trigger, wherein the hammer has a first stop for holding the hammer in a completely cocked position and the trigger arm has a first trigger arm stop edge for engaging with an associated first hammer stop of the hammer. In order to allow pulling of the trigger with lower trigger weight even in the double-action mode, the hammer contains a second stop for holding the hammer in a partially pre-cocked position and the trigger arm has a second trigger arm stop edge for engaging an associated second hammer stop of the hammer.

12 Claims, 6 Drawing Sheets

TRIGGER SYSTEM FOR HAND FIREARMS

FIELD OF THE INVENTION

The invention concerns a trigger system for hand firearms.

BACKGROUND OF THE INVENTION

So-called single-action/double-action trigger systems for hand firearms are known, in which there is the ability to move the hammer, e.g., by means of an uncocking lever, in a controlled and safe way from a single-action position (hammer completely cocked) into a double-action position (hammer completely uncocked). However, in the double-action mode, such trigger systems feature a relatively high trigger weight, because here the hammer must be moved uncocked against the force of the mainspring into the cocked position for discharging a shot. However, the expenditure of force required for this purpose can lead to reduced shooting precision.

SUMMARY OF THE INVENTION

An object of the invention is the design of a trigger system of the type named above, which enables triggering also in the double-action mode with lower trigger weight and which remains functional even for a failure to fire.

This object is achieved by a trigger system as set forth in the claims. Preferred configurations and advantageous improvements of the invention are also provided in the claims.

In comparison with known single-action/double-action trigger systems, the hammer is partially pre-cocked for the trigger system according to the invention in double-action mode and in this position also provides a favorable lever ratio of the stops of the engaged trigger arm and hammer to the hammer pin. Therefore, the double-action mode enables a trigger resistance that is smaller compared with conventional systems.

A hand firearm equipped with the trigger system according to the invention can always be carried in a partially pre-cocked state, without the risk of unintentional discharge of a shot. In this partially pre-cocked state, the hammer is held in a partially cocked position, wherein, in this position, the mainspring force is not yet sufficient to insert a cartridge for firing. From this position, however, the trigger system can be activated with an expenditure of force that is smaller compared with conventional double-action systems, because the mainspring no longer has to be tensioned by the entire amount for triggering.

Through repeating (manual activation of the action or through the action returning due to the recoil after the discharge of the first shot), the trigger system is led into a pre-cocked single-action position. From this position, the trigger system can be activated with low expenditure of force, because only the stop edge of the catch must be pressed out of the stop of the pre-cocked hammer. The force is transferred by means of the trigger, trigger arm, release lever, and catch.

Even if there is a failure to fire or empty striking (no cartridge in the cartridge block), activation of the trigger system is possible. Due to the second trigger arm stop edge and an associated second hammer stop, the hammer can then also be cocked and struck again. However, due to an unfavorable lever ratio of the here functional second trigger arm stop edge and the associated hammer stop to the pivot point of the hammer, a higher expenditure of force is required for drawing out of this position.

BRIEF DESCRIPTION OF THE DRAWINGS

Other details and advantages of the invention result from the following description of a preferred embodiment with reference to the drawing. Shown are.

DETAILED DESCRIPTION OF THE INVENTION

Figure 1:
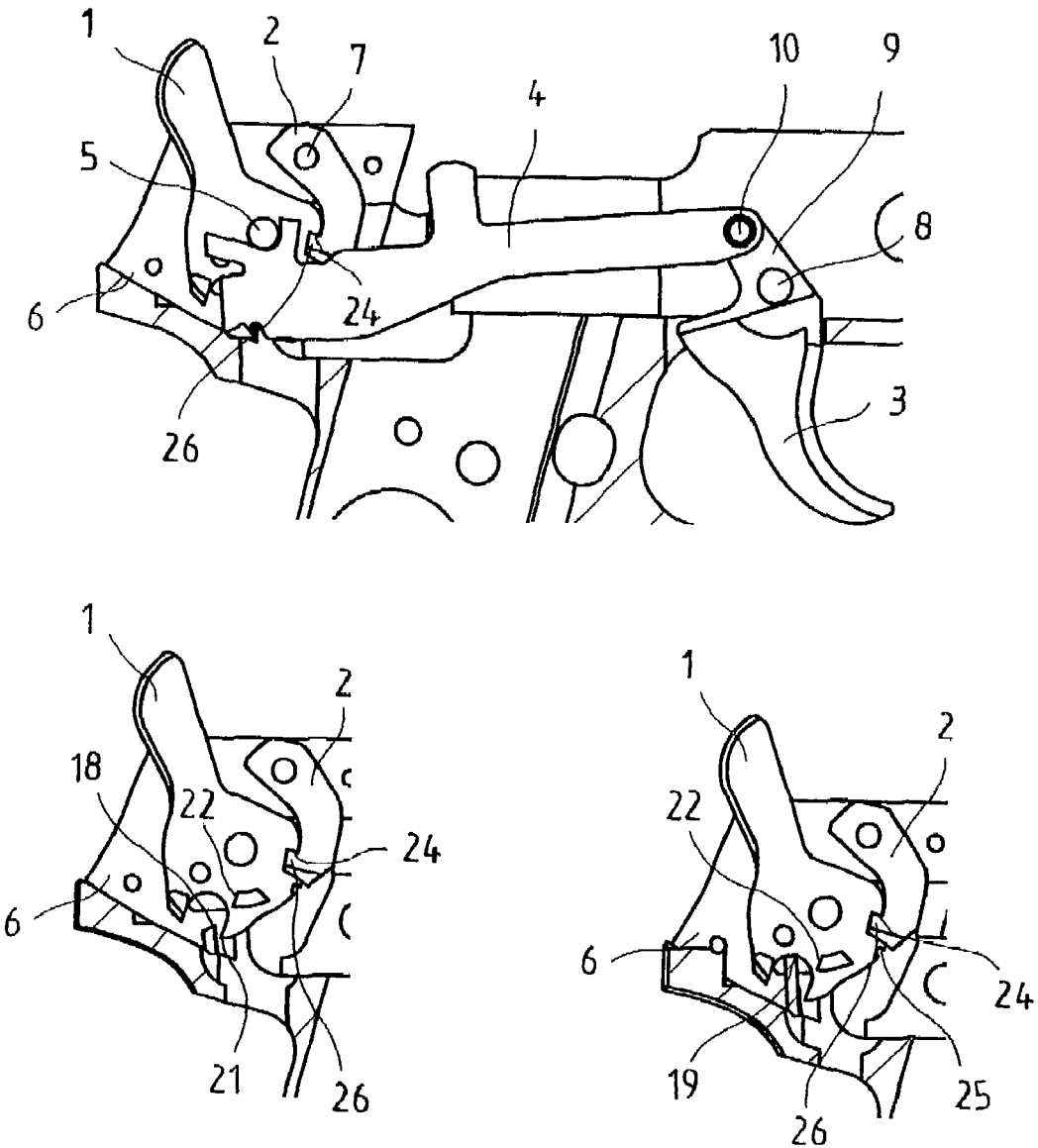
FIG. 1, a trigger system according to the invention for a hand firearm in a partially pre-cocked double-action position.

The trigger system of a hand firearm shown schematically in different positions in FIGS. 1 to 4 contains a hammer 1 with a catch 2, a trigger 3, and a trigger arm 4, which is connected in an articulated way to the trigger and by means of which, when the trigger 3 is pulled, the hammer 1 is first cocked against the force of a not-shown mainspring and then released for firing a shot. The trigger arm 4 is forced backwards and upwards by means of a not-shown trigger arm spring.

As follows from the above descriptions of FIGS. 1 to 4, the hammer 1 can rotate about a hammer pin 5 between two side parts of a handle or built-in part 6 spaced apart from each other. Between the two side parts of the handle or built-in part 6, the catch 2 is mounted so that it can rotate about a transverse pin 7. By means of this catch 2, the hammer 1 is held in a partially pre-cocked position or a completely cocked position, which is explained below in more detail. The trigger 3 can rotate about a trigger pin 8 on the handle or built-in part 6. It contains a link part 9 pointing diagonally upwards with a pivot pin 10, on which the front end 11 of the trigger arm 4 is coupled.

Figure 5:
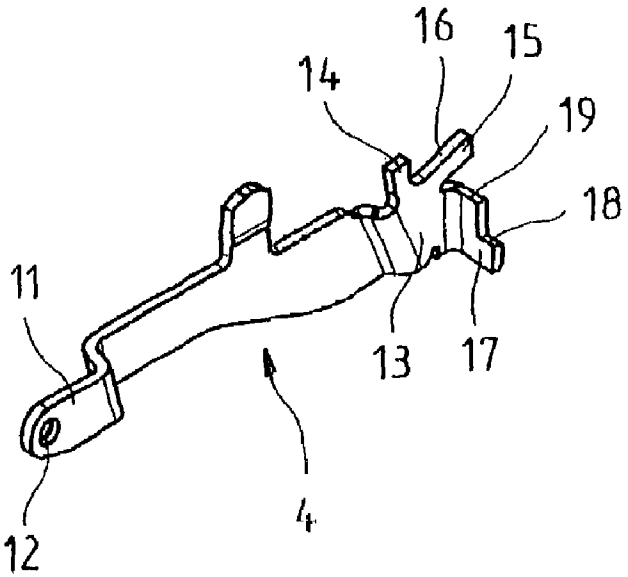
FIG. 5, the trigger arm of the trigger system shown in FIGS. 1 to 4 in a schematic perspective view.

The trigger arm 4 shown separately in FIG. 5 has on its front end 11 crimped inwards a bore 12 for placement on the pivot pin 10 of the trigger 3. At its rear end 13 also crimped inwards, the trigger arm 4 has a radial cam 14 projecting upwards, a connecting piece 15 extending backwards with a control bevel 16 running diagonally upwards, and a section 17 bent inwards at a right angle in the direction of the hammer with a first lower trigger arm stop edge 18 and a second trigger arm stop edge 19 offset from the first edge towards the side and the top.

Figure 6:
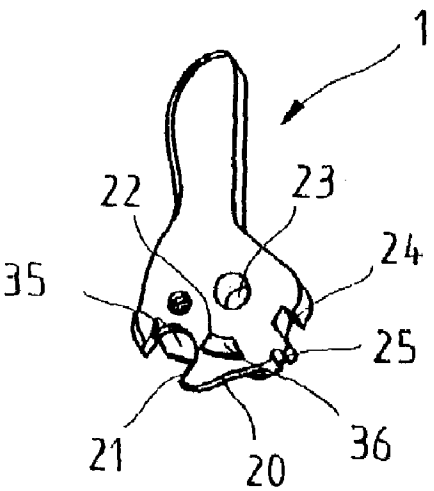
FIG. 6, the hammer of the trigger system shown in FIGS. 1 to 4 in a schematic perspective view.

As follows from FIG. 6, the hammer 1 has on its bottom side a radial cam 20 and a first lower hammer stop 21. The hammer 1 further contains on its side facing the trigger arm 4 a second upper hammer stop 22 projecting laterally. The first hammer stop 21 is used for engaging the trigger arm stop edge 18. In contrast, the second hammer stop 22, which is offset above the first hammer stop 21 and towards the front relative to the first stop, is led into engagement with the trigger arm stop edge 19. While the first hammer stop 21 is arranged at a side cutaway section 35 on the side of the hammer 1 facing the trigger arm 4, the second hammer stop 22 is located on a side projection 36 on the side of the hammer 1 pointing towards the trigger arm 4. Above the second hammer stop 22, the hammer 1 also contains a transverse bore 23 for the hammer pin 5 shown in FIG. 1, by means of which the hammer 1 can rotate between the side parts of the handle or built-in part 6. On the front side of the hammer 1, there is also the upper and lower stop 24 or 25 for engaging the catch 2.

Figure 7:
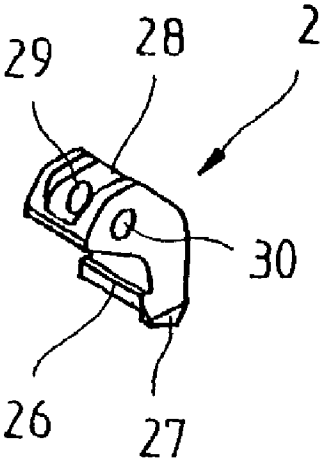
FIG. 7, the catch of the trigger system shown in FIGS. 1 to 4 in a schematic perspective view, and FIG. 8, the release lever of the trigger system shown in FIGS. 1 to 4 in a schematic perspective view.

The catch 2 shown separately in FIG. 7 has on its bottom side a catch stop 26 for engaging the stops 24 or 25 of the hammer 1. The catch 2 also contains a carrier 27, which projects laterally and which interacts with a carrier 33 of a release lever 31 shown in FIG. 8. The catch 2 has on its front side a groove 28, in which a leg spring is housed for pre-cocking the catch 2. Furthermore, in the catch 2 there are two aligned bores 29 and 30 for the transverse pin 7.

Figure 8:
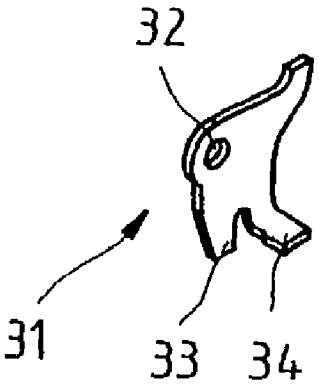

In FIG. 8, the release lever 31 is shown, which can also rotate about the transverse pin 7. For this purpose, the release lever 31 has a bore 32. The release lever 31 contains, in addition to the carrier 33 projecting downwards, a connecting piece 34, which is bent inwards and which interacts with the connecting piece 14 of the trigger arm 4.

The function of the trigger system according to the invention is explained below with reference to FIGS. 1 to 4, wherein, in the top illustration of each figure, the trigger arm 4 is shown completely and in the bottom illustration only the functional elements of the corresponding components are shown.

FIG. 1 shows the trigger system in a partially pre-cocked double-action position. In this position, the catch stop 26 engages the catch 2 in the upper stop 24 of the hammer 1, whereby the hammer 1 is held in a position in which the force of the not-shown mainspring would not yet be sufficient to fire a cartridge. As follows from the lower left illustration of FIG. 1, the hammer 1 can be activated by means of the lower trigger arm stop edge 18 interacting with the lower hammer stop 21. Because the lower hammer stop 21 has a greater distance from the hammer pin 5 than the upper hammer stop 22, the hammer 1 can be activated from this position with lower trigger resistance. The upper trigger arm stop edge 19 shown in the lower right illustration and the lower stop 25 of the hammer 1 are not functional in the partially pre-cocked double-action position.

Figure 2:
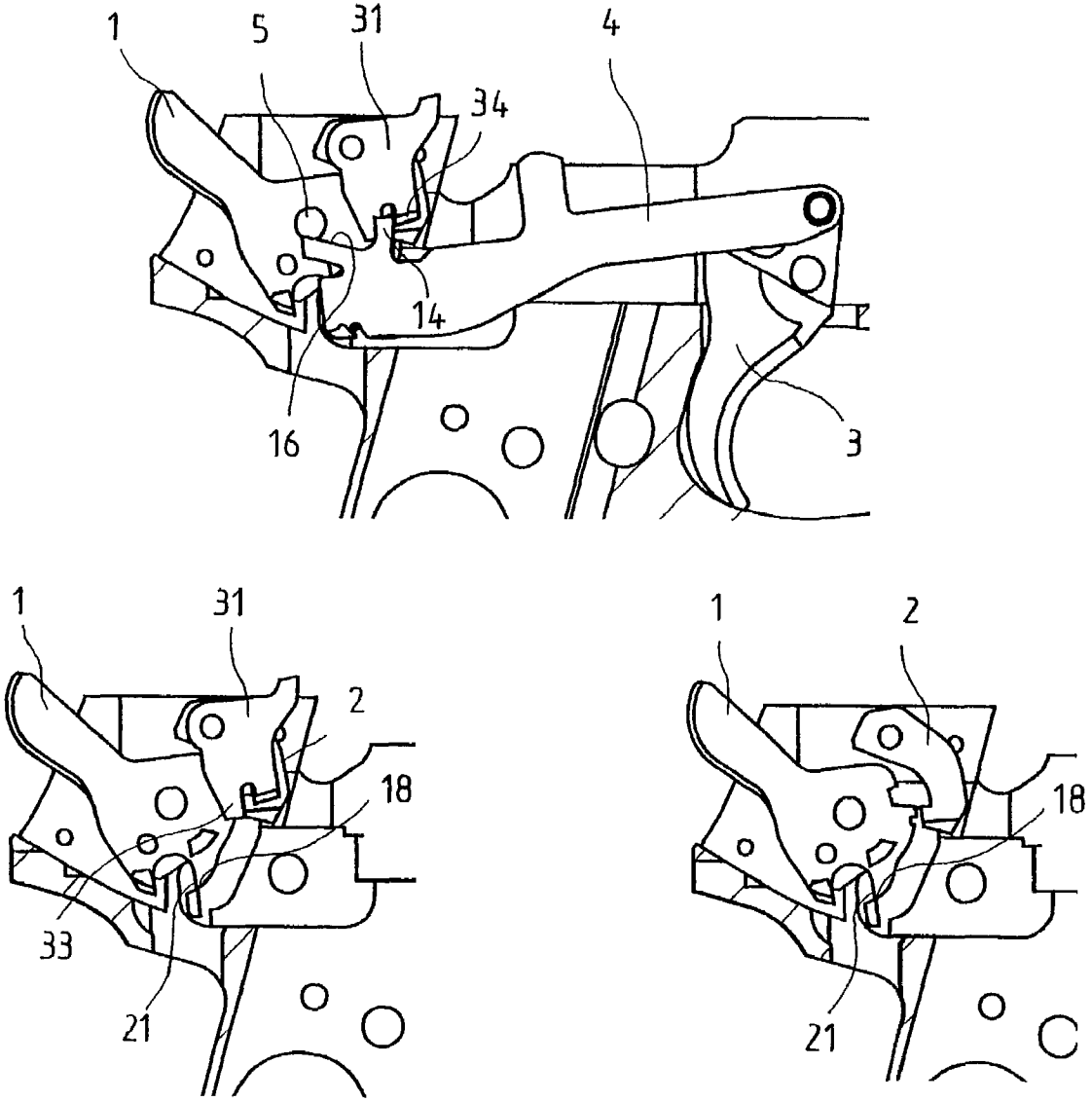
FIG. 2, the trigger system shown in FIG. 1 for the activation of the trigger from the partially pre-cocked double-action position shown in FIG. 1.

By pulling the trigger 3 in the partially pre-cocked double-action position shown in FIG. 1, the partially pre-cocked hammer 1 according to FIG. 2 is cocked further by the trigger arm 4 over the lower trigger arm stop edge 18 engaged with the lower hammer stop 21. During the cocking process, the trigger arm 4 is moved downwards over the cam bevel 16 of the trigger arm 4 contacting the hammer pin 5 in a position in which the trigger arm stop edge 18 is disengaged from the associated hammer stop 21 and thus the hammer 1 is released for firing a shot. In the course of the cocking process, the release lever 31 is pivoted upwards by the radial cam 14 of the trigger arm 4, which engages with the connecting piece 34 of the release lever 31. In this way, the catch 2 is also brought and held in a position that enables the striking of the hammer 1, by means of the carrier 33 of the release lever 31 and the associated side carrier 27 on the catch 2.

Figure 3:
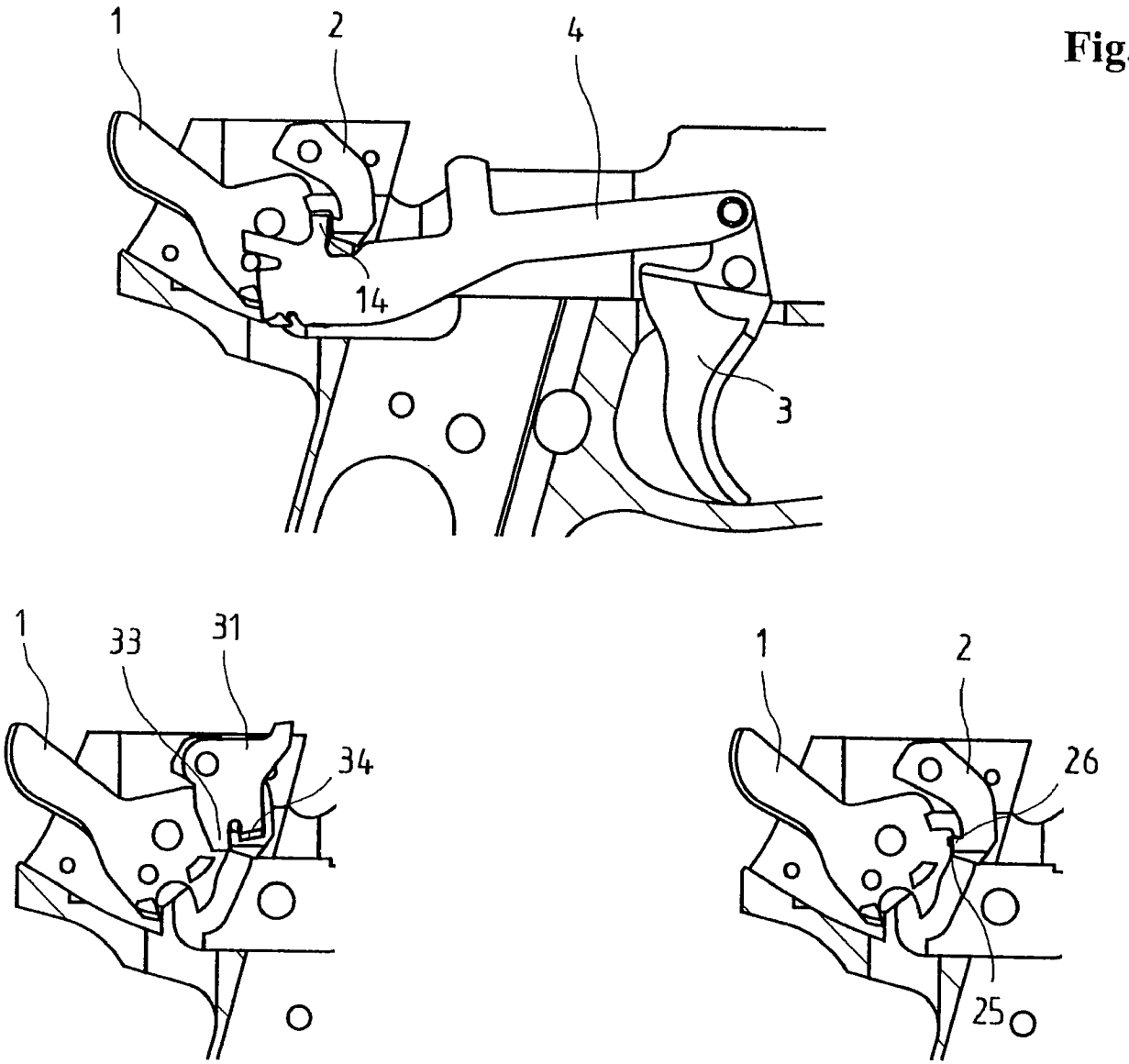
FIG. 3, the trigger system shown in FIG. 1 in a cocked single-action position.

FIG. 3 shows the trigger system in a cocked single-action position. The trigger system assumes this position through repeating (manually drawing back the action or returning the action due to the recoil impulse from the discharge of a shot). In this single-action position, the hammer 1 is held in its completely cocked position through the engagement of the catch stop 26 in the lower stop 25 of the hammer 1. When the trigger 3 is pulled, the release lever 31 is pivoted upwards by the radial cam 14 of the trigger arm 4 and the connecting piece 34 of the release lever 31. In this way, the catch 2 is also rotated by the carrier 33 of the release lever 31 and the associated side carrier 27 on the catch 2, so that the catch stop 26 is lifted from the lower stop 25 of the hammer 1 and thus the hammer 1 is released. By means of an uncocking lever not shown here, the trigger system can be brought controlled and safely in a known way from the single-action position into the pre-cocked double-action position.

Figure 4:
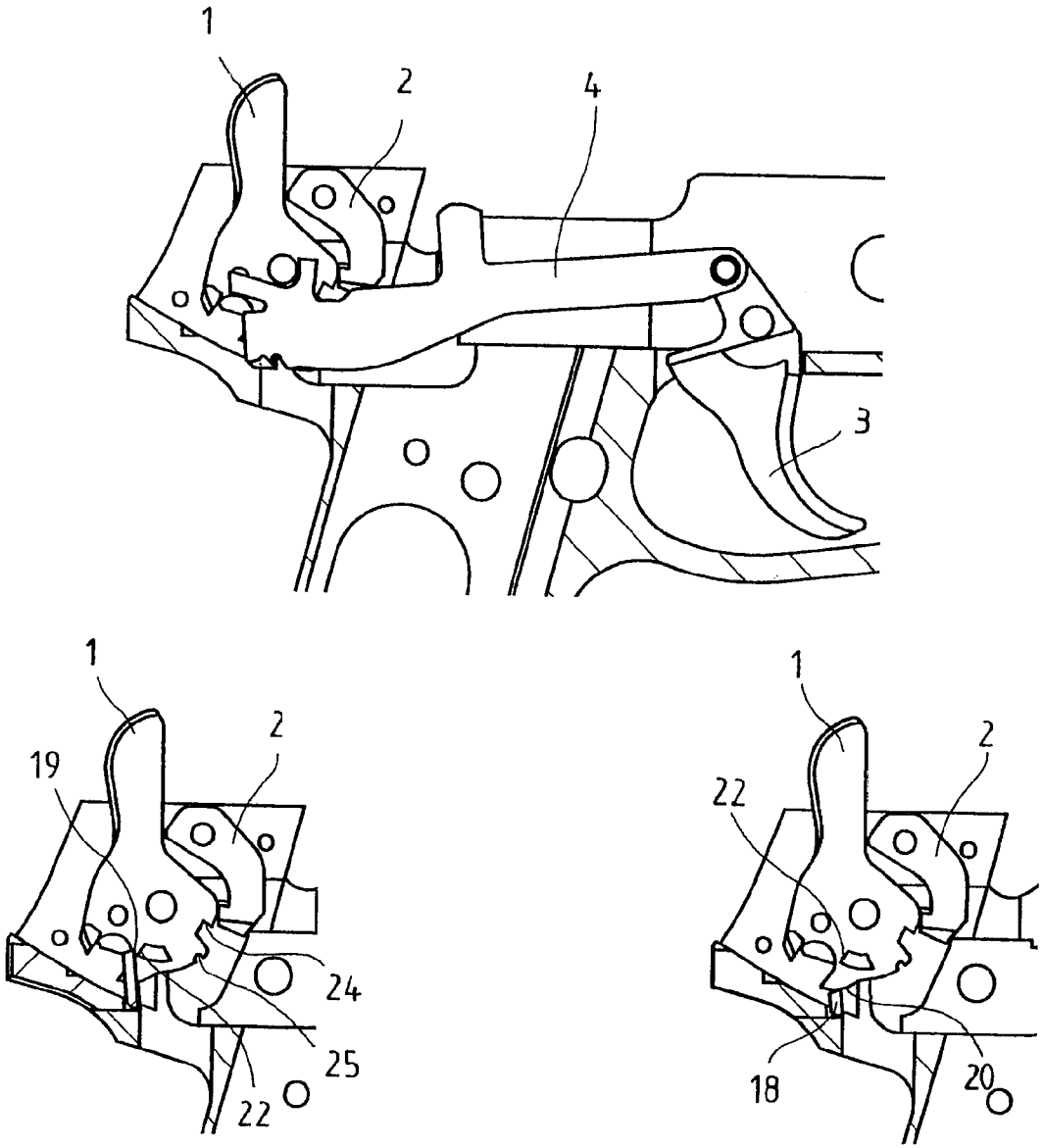
FIG. 4, the trigger system shown in FIG. 1 after a failure to fire.

In FIG. 4, the trigger system described above is shown in a position after a failure to fire or striking with an empty cartridge block. The hammer 1 is located in an uncocked front starting position. In this position, the trigger arm stop edge 19 engages with the upper hammer stop 22. By pulling the trigger 3 again, the hammer 1 can be cocked and struck again by means of the trigger arm stop edge 19 and the upper hammer stop 22. Because the upper hammer stop 22 has a smaller distance from the hammer pin 5 than the lower hammer stop 21, here an increased expenditure of force is required. In this process, the trigger arm 4 is moved into a position in which the trigger arm stop edge 19 and the hammer stop 22 are no longer functional, by means of the similarly functional trigger arm stop edge 18 and the radial cam 20 on the hammer 1.

What is claimed is:

1. Trigger system for hand firearms comprising:

a hammer including a first holding stop, a second holding stop, a first hammer stop, and a second hammer stop positioned on a side projection of the hammer, wherein the first hammer stop holds the hammer in a completely cocked position and the second holding stop holds the hammer in a partially pre-cocked position;

a catch allocated to the hammer;

a trigger; and a trigger arm interacting with the trigger, the trigger arm including a first trigger arm stop edge and a second trigger arm stop edge, wherein the first trigger arm stop edge is engagable with the first hammer stop of the hammer and the second trigger arm stop is engagable with the second hammer stop, wherein the second hammer stop faces the trigger arm.

2. Trigger system according to claim 1, wherein the first hammer stop is used for activating the partially pre cocked hammer and the second hammer stop is used for activating the uncocked hammer.

3. Trigger system according to claim 1, wherein the first hammer stop has a greater distance from a hammer pin than the second hammer stop.

4. Trigger system according to claim 1, wherein the first hammer stop is arranged at a side cutaway section on the side of the hammer facing the trigger arm.

5. Trigger system according to claim 1, wherein the second hammer stop of the hammer is arranged above the first hammer stop.

6. Trigger system according to claim 1, wherein the second hammer stop is arranged above the first hammer stop and offset on the hammer towards the front relative to the first hammer stop.

7. Trigger system according to claim 1, wherein the trigger arm contains a front end crimped inwards and a rear end crimped inwards with a radial cam projecting upwards, a connecting piece extending backwards with an upper cam bevel and a section bent at a right angle in the direction of the hammer, on which the first and second trigger arm stop edges are arranged.

8. Trigger system according to claim 1, wherein the catch is coupled to the trigger arm by a release lever.

9. Trigger system according to claim 8, wherein the catch contains a side carrier for engagement with a carrier of the release lever.

10. Trigger system according to claim 9, wherein the release lever contains a connecting piece bent at a right angle for engaging the trigger arm.

11. Trigger system according to claim 1, wherein the catch contains on a bottom side a catch stop for engaging the two holding stops of the hammer.

12. A trigger system for hand firearms comprising:

a hammer including a first holding stop, a second holding stop, a first hammer stop, and a second hammer stop positioned on a side projection of the hammer, wherein the first hammer stop holds the hammer in a completely cocked position and the second holding stop holds the hammer in a partially pre-cocked position;

a catch allocated to the hammer, wherein the catch is coupled to the trigger arm by a release lever;

a trigger; and a trigger arm interacting with this trigger, the trigger arm including a first trigger arm stop edge and a second trigger arm stop edge, wherein the first trigger arm stop edge is engagable with the first hammer stop of the hammer and the second trigger arm stop is engagable with the second hammer stop, wherein the second hammer stop faces the trigger arm.

* * * * *